United States Patent [19]

Burns et al.

[11] Patent Number: 5,062,421

[45] Date of Patent: Nov. 5, 1991

[54] RESPIRATORY MASK HAVING A SOFT, COMPLIANT FACEPIECE AND A THIN, RIGID INSERT AND METHOD OF MAKING

[75] Inventors: James A. Burns, Lake Elmo; Joseph G. Reischel, St. Paul, both of Minn.

[73] Assignee: Minnesota Mining and Manufacturing Company, St. Paul, Minn.

[21] Appl. No.: 657,102

[22] Filed: Feb. 19, 1991

Related U.S. Application Data

[63] Continuation of Ser. No. 121,069, Nov. 16, 1987, abandoned.

[51] Int. Cl.[5] ..... A62B 7/10

[52] U.S. Cl. ..... 128/205.27; 128/206.12; 128/206.17

[58] Field of Search ..... 128/205.27, 206.12, 128/206.16, 206.17

[56] References Cited

U.S. PATENT DOCUMENTS

| | | | |
|---|---|---|---|
| 2,505,173 | 4/1950 | Conley | 128/141 |
| 2,652,828 | 9/1953 | Matheson | 128/146 |
| 2,664,887 | 1/1954 | Green | 128/146 |
| 2,845,927 | 8/1958 | Hill | 128/146 |
| 2,922,417 | 1/1960 | Bradley et al. | 128/141 |
| 3,118,445 | 1/1964 | Norman | 128/141 |
| 3,161,491 | 12/1964 | Gongoll et al. | 55/502 |
| 3,330,274 | 7/1967 | Bennett | 128/146.7 |
| 3,861,381 | 1/1975 | Witman et al. | 128/146.6 |
| 4,155,358 | 5/1979 | McAllister et al. | 128/146.6 |
| 4,414,973 | 11/1983 | Matheson et al. | 128/206.15 |
| 4,494,538 | 1/1985 | Ansite | 128/205.25 |
| 4,501,272 | 2/1985 | Shigematsu et al. | 128/206.15 |
| 4,549,543 | 10/1985 | Moon | 128/206.12 |
| 4,592,350 | 6/1986 | Maryyanek et al. | 128/206.17 |
| 4,630,604 | 12/1986 | Montesi | 128/206.15 |

FOREIGN PATENT DOCUMENTS

| | | |
|---|---|---|
| 1802814 | 6/1970 | Fed. Rep. of Germany . |
| 80116 | 7/1963 | France . |

*Primary Examiner*—Edgar S. Burr
*Assistant Examiner*—Aaron J. Lewis
*Attorney, Agent, or Firm*—Gary L. Griswold; Walter N. Kirn; Eloise J. Maki

[57] ABSTRACT

The novel respiratory mask has a soft, compliant facepiece to which is permanently sealed a relatively thin, rigid insert. The insert has swept back cheek portions, each formed with an aperture at which a filter cartridge is snapped into place through an opening in the facepiece. Adjacent said opening, the facepiece has a rigid which is bent over and stretched outwardly by the cartridge to create a hermetic seal. Each filter cartridge is asymmetric and swept back to shift the center of gravity inwardly toward the wearer's head, thus making the mask seem to be lighter to a wearer than is a conventional respiratory mask of equal weight which has a center of gravity in front of the wearer's head. Fitted over an annular flange around a central aperture of the insert is a harness attachment. Because the insert and harness attachment can be lightweight, the mask can be lighter in weight than are prior masks having filters of equal weight. The novel respiratory mask can be of low cost, thus making it economical to be discarded after each use.

21 Claims, 2 Drawing Sheets

RESPIRATORY MASK HAVING A SOFT, COMPLIANT FACEPIECE AND A THIN, RIGID INSERT AND METHOD OF MAKING

This is a continuation of application Ser. No. 07/121,069 filed Nov. 16, 1987, now abandoned.

BACKGROUND OF THE INVENTION

1. Field of the Invention

The invention concerns respiratory masks, especially of the type useful for protecting the wearer against gases and vapors.

2. Description of the Related Art

Respiratory masks which feel the most comfortable to wear have a facepiece molded of a soft, compliant rubber formed with an inturned cuff or flap having a feathered edge that forms a hermetic seal against the wearer's facial skin. Because of the softness of the rubber, major surfaces of typical facepieces are rather thick to provide enough body to bear the weight of the cartridges while also supporting an exhalation valve. See, for example, FIG. 4 of U.S. Pat. No. 2,652,828 (Matheson). The thickness of the rubber can make the mask heavy to wear. In order to achieve adequate service life in protecting against gases and vapors, respiratory masks typically utilize two rather large and heavy filters which can add greatly to the weight felt by the wearer.

When a respiratory mask has a fitting in each cheek area for a filter cartridge, the fittings and cartridges typically are formed with mating threads to permit the filter medium to be replaced. See, for example, FIG. 10 of U.S. Pat. No. 4,414,973 (Matheson et al.). When replaceable filter cartridges are screwed into place, they can leak if cross-threaded or if not screwed in tightly at all times during use. Screw-in cartridges typically are round to facilitate threading. If a holder for a screw-in cartridge were asymmetric, it could be accidentally rotated into the wearer's field of vision when the cartridge is tightened.

When harness attachments are fastened to the facepiece as in FIG. 1 of the Matheson et al patent, the facepiece must be thick enough in the attachment areas to withstand forces applied in strapping the facepiece to the wearer's head, thus adding additional weight.

Respiratory masks which have a single filter cartridge involve the same problems. See, for example, U.S. Pat. No. 4,155,358 (McAllister et al.) which shows a valveless respirator having a single oval-shaped chemical cartridge.

Filter media which do not protect wearers against vapors and gases typically are of substantially lower weight than those which do. Such a respiratory mask is shown in U.S. Pat. No. 4,592,350 (Maryyanek et al.) wherein "Two inhalation valve mechanisms 24 are positioned through circular holes in the facepiece body in opposing positions on either side of the wearer's mouth" (col. 3, lines 59–61). "Triangular-shaped filter covers 16 snap onto each of the filter holders 22 to contain and protect the filter 14" (col. 4, lines 54–55). The filter covers are asymmetrically mounted to extend laterally from the cheek areas, so that the filter media can have larger areas than would be feasible for a circular filter cartridge. Even though particulate filter media can be of much lighter weight than filter media which are effective against gas vapors, FIG. 2 of Maryyanek patent shows that its facepiece 12 is much thicker where it supports the filter holders than it is at the feathered cuff or flap. Hence, the Maryyanek mask may be rather heavy to wear even with lightweight filter media.

The Maryyanek patent does not suggest that the filter holders are held in place by anything but friction, probably to permit the filter holders to be removable for cleaning. Hence, if Maryyanek's filters were exchanged for gas and vapor filters, their greater weight could cause accidental rotation of the filter holders.

When a respirator mask has a single filter cartridge, the cartridge can be swept back along both cheeks of the wearer as illustrated in FIG. 9 of U.S. Pat. No. 4,501,272 (Shigematsu et al.) which concerns a particulate respirator mask. Such a respirator mask can have either one or two inhalation valves. Another such respirator mask having a single swept-back filter cartridge is shown in U.S. Patent No. 4,630,604 (Montesi) which also concerns a particulate respirator mask. Its inhalation and exhalation valves are coaxial.

Scott (a Figgie International Company in Lancaster, N.Y.) markets a Model 66 respirator mask with a half facepiece consisting of a rigid member fitted into a soft, compliant "face seal". The rigid member has a central aperture for an exhalation valve and a pair of swept-back cheek portions. A cylindrical projection from each cheek portion is externally threaded to receive a cylindrical filter cartridge.

Scott also markets a Model 65 respirator mask which has a full facepiece consisting of a transparent rigid member fitted into a soft, compliant face seal. Its rigid member has only one opening for an assembly containing an exhalation valve and two filter cartridges.

U.S. Pat. No. 4,549,543 (Moon) shows a respiratory mask that apparently is intended only to protect against particulate matter. It has a single filter cartridge which is located under the user's chin for aesthetic purposes. Also for aesthetic purposes, the facepiece is formed of flexible transparent sheet material such as polyethylene or polyvinyl chloride.

For other respirator masks, see U.S. Pat. Nos. 2,662,887 (Green) and 2,505,173 (Conley).

2. Other Prior Art

While the following patent does not concern respiratory masks, it is of interest in having a similarity to the respiratory mask of the present invention.

U.S. Pat. No. 3,330,274 (Bennett) shows a face mask fitted with a flexible conduit to suitable respiration apparatus, primarily for the medical treatment of respiratory disorders. As seen in FIGS. 1 and 2, the face mask consists of a "face piece 12" of relatively stiff and transparent plastic material and a "resilient, deformable sealing cuff 14" extending entirely around the perimeter of the face piece.

SUMMARY OF THE INVENTION

The invention provides a respiratory mask which, when fitted with filters for protecting against gases and vapors, can have greatly reduced weight compared to prior respiratory masks that have equal filter areas. It is believed that the novel respiratory mask can be manufactured at substantially less cost than prior respiratory masks while providing equivalent protection. The cost of the novel respiratory mask can be so low that even when fitted with filters that protect against gases and vapors, it can be discarded after each use at no greater total costs than the purchase price of replaceable cartridges plus cleaning and maintenance costs of conventional reusable respiratory masks of comparable performance. Furthermore, respiratory masks of the invention may be less susceptible to accidental leakage than are conventional reusable respiratory masks.

Like typical respiratory masks of the prior art, that of the invention has a soft, compliant facepiece. The facepiece of the respiratory mask of the invention differs from prior respiratory masks by having at least one opening and a relatively thin, rigid structural member (here usually called an "insert") permanently sealed to the facepiece. The structural member or insert has an aperture, the perimeter of which lies close to and within the perimeter of said opening. The aperture is adapted for attachment of a filter holder in hermetically sealed relationship to the facepiece. Adjacent said opening, the facepiece has a ridge that has an outwardly sloped, substantially feathered edge and so is bent over and stretched outwardly by an attached filter holder to ensure a hermetic seal.

In a preferred prototype respiratory mask of the invention, the insert has a pair of substantially flat, swept back cheek portions, each of which has an aperture as described above, into which a filter holder can be fitted. Because of the thinness of the insert, a respiratory mask of the invention can be lightweight and yet durable. Because of the rigidity of the insert, the edge of each cheek aperture can be formed to permit a filter holder to be snapped into place and thus securely sealed to the insert while being prevented from rotating.

When the novel respiratory mask is designed to be discarded after use, the filter holders preferably are cartridges which are permanently snapped into place. Alternatively, when the novel respiratory mask is to be reused, the filter holders preferably are platforms which are permanently snapped into place, and filter cartridges are detachably sealed to the platforms. Whether the filter holders are cartridges or platforms, filter media suitable for protecting against gases and vapors or particulate matter or both can be used with the novel respiratory mask.

DETAILED DESCRIPTION

Preferably, each swept-back cheek portion of the insert forms an angle of from 20° to 70° with the plane of symmetry of the mask. More preferably, the angle is from 35° to 55°. Each filter holder and its filter preferably are asymmetric and swept back laterally from the cheek aperture into which the filter holder is fitted. The filter media can thus extend laterally for a considerable distance without interfering with either the wearer's vision or head movements. This permits a larger filter area, thus making breathing easier. Because the weight of the filter media makes up a high percentage of the total weight of the novel mask, large swept-back filter cartridges tend to shift the center of gravity of the mask behind the tip of the wearer's nose toward the cheek areas, thus substantially reducing the moment tending to force the wearer's head to bow downwardly. This makes the novel respiratory mask feel lighter to wear than does a respiratory mask of equal weight which has projecting filter cartridges and thus has a center of gravity in front of the wearer's head.

The insert should also accommodate an exhalation valve extending through a central opening of the facepiece. At the exhalation valve, the insert preferably is formed to receive a harness attachment so that the facepiece does not need to be thickened and strengthened to withstand strapping forces. The insert preferably is a thermoplastic resin which is sufficiently tough and rigid to permit a cartridge to remain securely snapped into place. The insert is molded of tough, rigid thermoplastic resin such as polypropylene or polyvinyl chloride and preferably is transparent to permit another person to inspect the wearer's face.

The novel respiratory mask is made using an injection mold having a cavity for forming a facepiece and adapted to receive the above-described insert. Its production involves the steps of 1) placing said insert into the mold,
2) closing the mold,
3) injecting into the mold a soft, compliant resin to form said facepiece around the insert, and
4) removing the molded facepiece and its insert from the mold.

The inserting step 1) can be accomplished using a multishot injection mold by forming the insert in the mold, either before or after forming the facepiece in step 3).

The resin injected in step 3) preferably is a thermoplastic rubber, thus permitting much faster production rates than have been possible with thermosetting rubbers that have been used in making most prior rubber facepieces. The thermoplastic rubber preferably comprises a block copolymer, at least one block of which is chemically similar to the thermoplastic resin of the insert, thus permitting the facepiece to become bonded to the insert during the molding process and ensuring against leakage between the facepiece and insert. When the insert is polypropylene, one segment of the thermoplastic rubber preferably is a polyolefin as in an oil-modified styrene-ethylene/butylene-styrene block copolymer.

THE DRAWING

The invention may be more understandable by reference to the drawing, all FIGURES of which are schematic, wherein.

Figure 1:
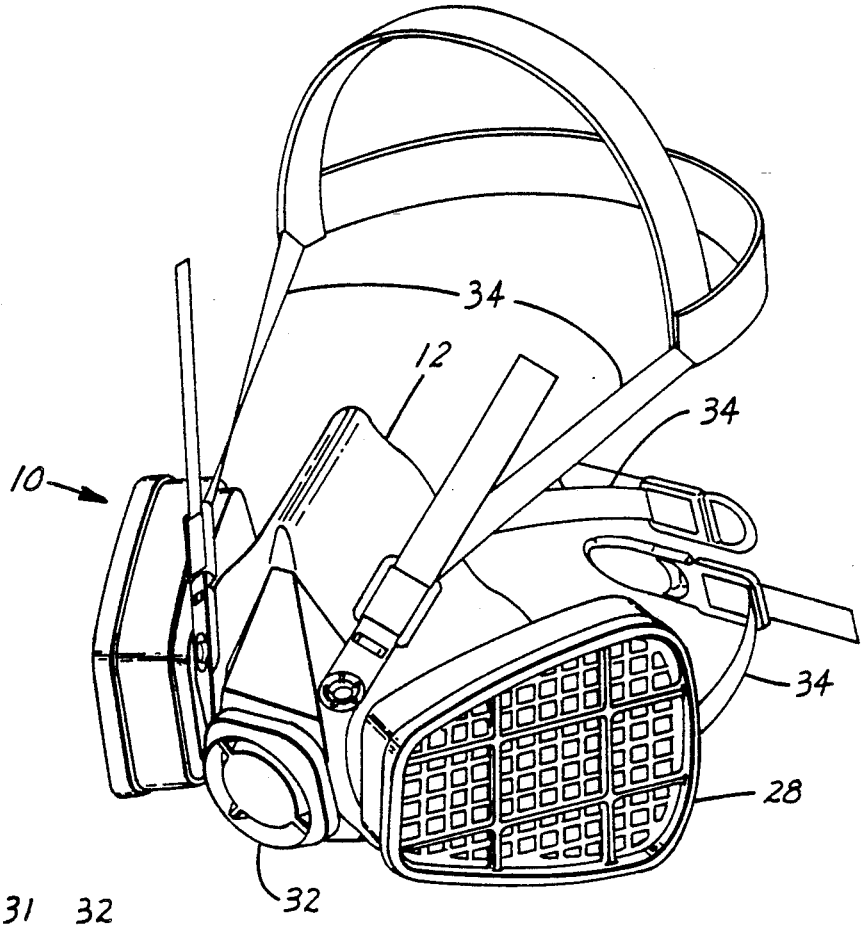
FIG. 1 is a perspective view of a respiratory mask of the invention.

The respiratory mask 10 shown in the drawing has a soft, compliant facepiece 12 with an inturned feathered cuff 14. To the facepiece 12 at a nose opening 16 and two circular cheek openings 18 is permanently sealed a relatively thin, rigid structural member or insert 20. The central portion of the insert is substantially flat and formed with a circular central nose aperture 22 into which is fitted an exhalation valve 24 having a diaphragm 25. Swept back from each side of the central portion of the insert 20 at an angle of about 53° with the plane of symmetry is a cheek portion which also is substantially flat and formed with a cheek aperture 26, at the edge of which are four notches 27, each of which receives a locking tab 29 projecting from a filter cartridge 28, thus permitting the cartridges to be snapped into place and prevented from rotating.

The filter cartridge 28 incorporates an inhalation valve (not shown).

Figure 4:
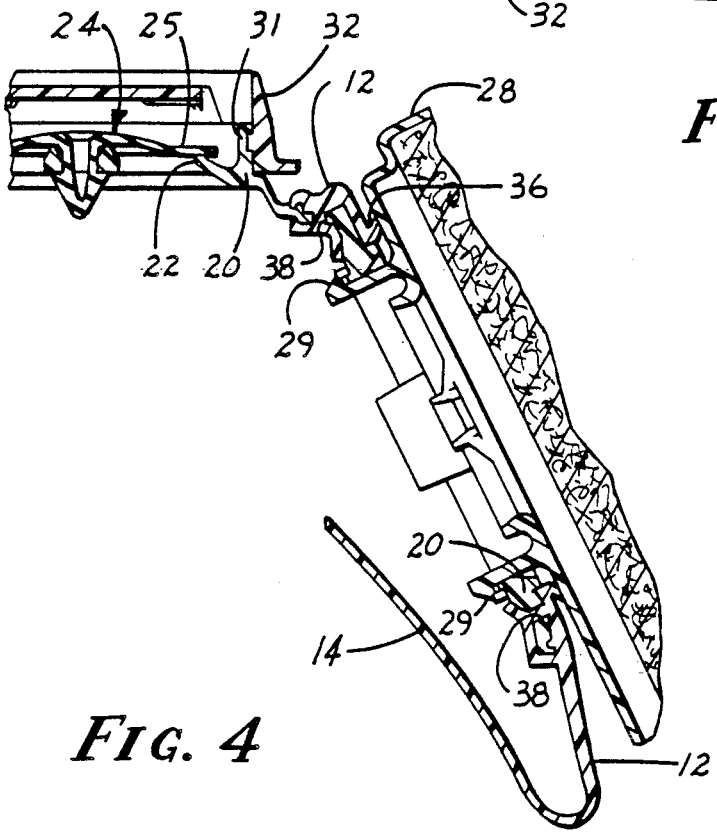
FIG. 4 is a partial, transverse cross section through the respiratory mask of FIG. 1.
Figure 5:
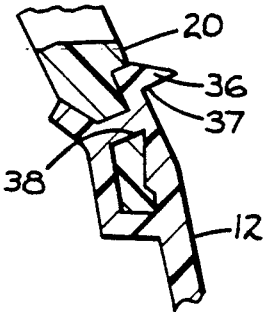
FIG. 5 is a fragmentary cross section along line 5—5 of FIG. 3.
Figure 3:
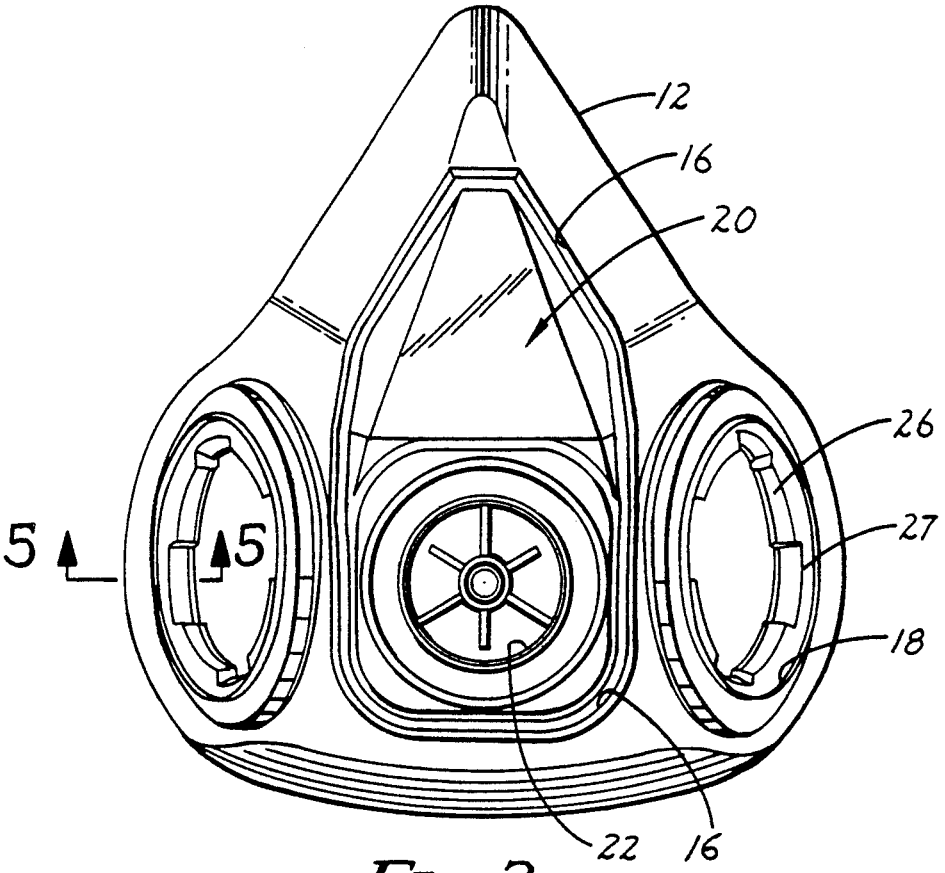
FIG. 3 is a front view of the facepiece of the respiratory mask of FIG. 1 which has been molded with the insert of FIG. 2 as an insert.

As seen in FIG. 1, each filter cartridge 28 is asymmetric and extends laterally for a considerable distance from its cheek aperture 26 without interfering with the wearer's vision. Fitted over an annular flange 31 (FIG. 4) around the nose aperture 22 of the insert 20 is a cap 32 to which adjustable straps 34 are attached to provide a harness attachment for fastening the mask 10 to a wearer's head. Adjacent each of its circular cheek openings 18, the facepiece 12 has an upstanding annular ridge 36 which slopes away from the cheek opening to a substantially feathered edge and is substantially triangular in cross section as seen in FIG. 5. The radially outer surface 37 of the ridge is orthogonal to the surface of the facepiece 12 so that when a filter cartridge 28 is snapped into place, the ridge 36 is partially bent over and stretched in the radially outward direction (as shown in FIG. 4) to provide a hermetic seal between the filter cartridge and the insert. By thus being stretched outwardly, compressive set of the facepiece material is substantially avoided.

In order to ensure that the entire ridge 36 is bent radially outwardly, the contacting surface of the filter cartridge can be sloped, but this should be unnecessary if reasonable care is taken in snapping the cartridge to the insert.

Although the filter cartridge 28 is designed to remain permanently in place, it could be detachable from a platform which would be permanently snapped into each of the cheek apertures 26. The term "filter holder" is here used to encompass both a filter cartridge and a filter platform.

Figure 2:
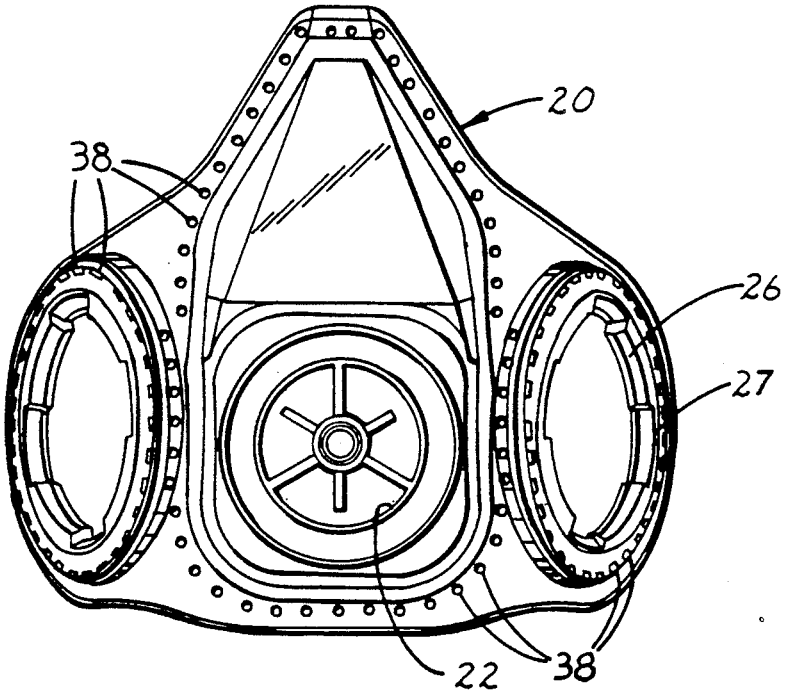
FIG. 2 is a front view of the insert of the respiratory mask of FIG. 1.

As seen in FIG. 2, a series of closely spaced perforations 38 through the insert 20 forms a continuous path around each of the central aperture 22 and the cheek apertures 26 of the insert. Synthetic resin used to form the facepiece 12 flows through the perforations 30 during the injection molding process to mechanically interlock the insert to the facepiece as shown in FIG. 4.

EXAMPLE

The respiratory mask shown in the drawing was prepared using a water-cooled injection mold designed to receive an insert 20 which had been molded of polypropylene resin (Himont "Pro Fax" PDS 701 from Himont USA, Inc., Wilmington, Del.). The mold was mounted in a 250-ton horizontal reciprocating screw thermoplastic injection molding machine (available from Cincinnati Machine Co.). An oil-modified styrene-ethylene/butylene-styrene block copolymer ("Kraton"G 2705 from Shell Chemical Co.) containing a light gray pigment was injected into the closed mold to form the facepiece of the respiratory mask. Molding conditions were:

| | |
|---|---|
| Heater Temperatures (°C.) | |
| Front | 182 |
| Center | 188 |
| Rear | 193 |
| Cycle Conditions (sec) | |
| Boost Time | 1.25 |
| Hold Time | 6.0 |
| Mold Closed | 10 |
| Mold Open | 1 |
| Overall Cycle | 56 |
| Setup Conditions | |
| Boost Pressure | 9,425 bar |
| Hold Pressure | 2,900 bar |
| Back Pressure | 2,175 bar |
| Screw Speed | 40 rpm |
| Injection Speed | 12 cm/sec |

Upon completion of the molding cycle, the mold was opened, and the facepiece and its sealed insert were removed from the mold. An exhalation valve and cover, buckles, straps, head harness, and filter cartridges containing sorbent media were attached to complete assembly of the respiratory mask.

The plastic insert 20 was approximately 0.6 mm in thickness, and the diameter of its cheek apertures 26 was about 3.4 cm. The thickness of the facepiece 12 beyond the insert 20 was about 1.75 mm, tapering to about 1.0 mm at the inner edge of the cuff 14 which tapered to about 0.6 mm at its outer edge. The annular ridge 36 had a diameter of about 4.5 cm and a height of about 2 mm. The thickness at its base was about 0.9 mm.

Performance evaluations of the assembled respiratory mask according to NIOSH standards 30 CFR Part 11, published in the Federal Registry on March 25, 1972, indicated that its performance met or exceeded the requirements for a gas and vapor protection certification. Test subjects reported that the mask of the present invention "felt lighter" to wear than conventional respiratory masks of substantially the same weight. This is attributed to a reduced bowing of the wearer's head as compared to the conventional respiratory masks.

The respiratory mask shown in the drawing can be modified by eliminating one of its filter cartridges, e.g., to make it easier for the wearer to fire a rifle. Among other useful modifications, the two filter cartridges could be replaced by a single cartridge that fits into a central aperture of a thin, rigid insert. That single cartridge preferably is V-shaped with each leg of the V being swept back alongside the wearer's cheeks, thus keeping the center of gravity of the mask behind the wearer's nose.

We claim:

1. A structural member for use in a facepiece of a respiratory mask, said structural member being thin and rigid relative to the facepiece and having a pair of substantially flat, swept back cheek portions, each formed with an aperture and structure around the aperture to mate with and hold a filter cartridge, and a central portion having a nose aperture for an exhalation valve, and provided with discontinuities permitting the facepiece material to flow through the discontinuities under molding conditions to form a mechanical seal to the structural member.

2. A structural member as defined in claim 1 wherein said discontinuities are provided by a series of closely spaced .perforations extending through the structural member.

3. A respirator mask comprising a soft, compliant facepiece adapted to mate with the wearer's face, a polymeric insert, and at least one filter holder;

wherein the insert is thin and rigid relative to the facepiece, functions as a supporting frame to the mask and has at least one aperture and structure around the aperture to mate with and hold said filter holder; and wherein the facepiece is molded in sealing engagement around the insert, the facepiece material having contacted the insert while in a liquid state so as to have flowed into contact with the insert thereby forming a permanent seal to the insert upon solidifying.

4. A respiratory mask according to claim 3 wherein the insert is provided with discontinuities permitting the facepiece material, while in a liquid state, to flow through the discontinuities thereby forming a permanent seal to the insert upon solidifying.

5. A respiratory mask according to claim 4 wherein the discontinuities are provided by a series of closely spaced perforations extending through the insert.

6. A respirator mask according to claim 3 wherein the facepiece adjacent said aperture has a radially sloped ridge with a substantially feathered edge that is bent outwardly and stretched by an attached filter holder to ensure a hermetical seal.

7. A respirator mask according to claim 3 wherein the structure around each aperture is formed to permit a filter holder to be snapped into place.

8. A respirator mask according to claim 3 wherein the edge of each aperture is formed with at least one notch into which a locking tab projecting from a filter holder fits to prevent a filter holder from rotating.

9. A respirator mask according to claim 4 wherein the mask has to filter holders, and the insert has a central portion and two swept back cheek portions extending from the central portion, each swept back cheek portion having an aperture and structure around the aperture to mate with and hold a filter holder.

10. A respirator mask according to claim 9 wherein the central portion of the insert includes an area that extends upwardly from a line extending between the apertures in the swept back cheek portions so as to extend over the nose of the person wearing the mask.

11. A respirator mask according to claim 10 wherein the central portion of the insert has an aperture for receiving an exhalation valve.

12. A respirator mask comprising a soft compliant facepiece adapted to mate with a wearer's face and including an insert for use in said facepiece of said respirator mask, said insert being thin and rigid relative to the facepiece and having a pair of substantially flat, swept back cheek portions, each formed with an aperture and structure around the aperture to mate with and hold a filter cartridge and a central portion having a nose aperture for an exhalation valve, and means for providing a mechanical interlock between the insert and the facepiece, said means including a plurality of discontinuities, said facepiece being made from a material which flows through said discontinuities under molding conditions, said facepiece being secured to said insert by material which has flowed though said discontinuities.

13. Respirator mask as defined in claim 12 wherein the discontinuities are provided by a series of closely spaced perforations extending through the insert.

14. A respirator mask of claim 12 wherein the edge of each aperture is formed with at least one notch into which a locking tab projecting from a filter cartridge fits to prevent a filter cartridge from rotating.

15. A respirator mask of claim 12 wherein the mask has two filter cartridges.

16. A respirator mask as defined in claim 15 wherein each filter cartridge comprises an asymmetric filter cartridge locked to the facepiece, each swept back laterally from a cheek aperture of the insert.

17. A respirator mask of claim 15 in which the central portion of the insert extends upwardly from a line extending between the apertures in the swept back cheek portions so as to extend over the nose of a person wearing the mask.

18. Respirator mask as defined in claim 17 wherein the insert is formed adjacent the nose aperture to receive a harness attachment.

19. Respirator mask as defined in claim 12 wherein each substantially flat swept back cheek portion is swept back at substantially the same angle of from 20° to 70° with the plane of symmetry of the mask.

20. A respirator mask of claim 12 wherein the facepiece adjacent each of said cheek apertures has a radially sloped ridge with a substantially feathered edge that is bent outwardly and stretched by an attached filter cartridge to ensure a hermetical seal.

21. A respirator mask of claim 12 wherein the structure around each cheek aperture is formed to permit a filter cartridge to be snapped into place.

* * * * *

UNITED STATES PATENT AND TRADEMARK OFFICE

CERTIFICATE OF CORRECTION

PATENT NO. : 5,062,421
DATED : November 5, 1991
INVENTOR(S) : Burns et al.

It is certified that error appears in the above-indentified patent and that said Letters Patent is hereby corrected as shown below:

Abstract, line 6, "rigid" should be --ridge--.

Col. 2, line 41, "2. Other Prior Art" should be --Other Prior Art--.

Signed and Sealed this

Twelfth Day of September, 1995

*Attest:*

*Attesting Officer*

BRUCE LEHMAN

*Commissioner of Patents and Trademarks*